US006928764B2

(12) United States Patent
Freed

(10) Patent No.: US 6,928,764 B2
(45) Date of Patent: Aug. 16, 2005

(54) GRIP EXTENDER FOR HANDGUN

(75) Inventor: Robert Freed, Kenmore, WA (US)

(73) Assignee: Freed Designs Inc., Kenmore, WA (US)

( * ) Notice: Subject to any disclaimer, the term of this patent is extended or adjusted under 35 U.S.C. 154(b) by 140 days.

(21) Appl. No.: 10/383,964

(22) Filed: Mar. 8, 2003

(65) Prior Publication Data

US 2004/0031181 A1 Feb. 19, 2004

Related U.S. Application Data

(63) Continuation-in-part of application No. 09/827,578, filed on Apr. 5, 2001, now abandoned.
(60) Provisional application No. 60/194,981, filed on Apr. 5, 2000.

(51) Int. Cl.[7] ..... F41A 9/61
(52) U.S. Cl. ..... 42/71.02; 42/7
(58) Field of Search ..... 42/7, 71.02

(56) References Cited

U.S. PATENT DOCUMENTS 4,343,107 A * 8/1982 Kaltenegger ..... 42/7
4,862,619 A * 9/1989 Baldus et al. ..... 42/7
5,438,783 A * 8/1995 Sniezak et al. ..... 42/50
5,526,600 A * 6/1996 Chesnut et al. ..... 42/50
5,533,291 A * 7/1996 Boland ..... 42/7
5,584,136 A * 12/1996 Boland et al. ..... 42/50
5,621,997 A 4/1997 Pearce
5,906,065 A * 5/1999 Pearce ..... 42/50
6,253,479 B1 * 7/2001 Fuchs et al. ..... 42/70.02

OTHER PUBLICATIONS

A&G Supply Co., Inc., "Get a Grip on It," advertisement published in *Guns & Weapons for Law Enforcement*, undated, p. 69.
Kel–Tec CNC Industries, Inc., <http://www.kel–tec.com/P11 Accessories> [retrieved Feb. 4, 2002].
Kel–Tec CNC Industries, Inc., Suggested Dealer Price List and Pistol Accessories, Dec. 1, 2000.
Pearce Grip, Inc. Product Description, List of Grips and Grip Extensions, Bothell, Washington, (undated).

* cited by examiner

*Primary Examiner*—Aileen Felton
*Assistant Examiner*—L. Semunegus
(74) *Attorney, Agent, or Firm*—James L Davison

(57) ABSTRACT

The present invention provides a grip extender for a handgun. The grip extender provides a relatively continuous surface between the handgun and locked magazine to afford the handgun user with a comfortable grip. The grip extender can be adapted to fit a variety of handguns and magazines.

4 Claims, 6 Drawing Sheets

GRIP EXTENDER FOR HANDGUN

CROSS REFERENCE TO RELATED APPLICATION

This application is a continuation in part of application Ser. No. 09/827,578, now abandoned, filed Apr. 5, 2001, which said application claimed the benefit of the priority of the filing date of U.S. provisional patent application No. 60/194,981, filed Apr. 5, 2000, which is incorporated herein by reference in its entirety.

FIELD OF THE INVENTION

The present invention relates to a device for extending a handgun grip.

BACKGROUND OF THE INVENTION

Handguns generally include a magazine that is housed in the handgun's grip. For certain handgun models, the use of a full size magazine results in the protrusion of the magazine from the handgun butt. Not only does the magazine's protrusion from the handgun provide for an awkward grip, the portion of the magazine that extends from the handgun is subject to being caught on a holster or other object of clothing on drawing the handgun.

Accordingly, there exists a need for a device for use in conjunction with a handgun and a full size magazine that provides for both a comfortable grip and lessens the likelihood of the magazine being caught when the handgun is drawn. The present invention seeks to fulfill these needs and provides further related advantages.

SUMMARY OF THE INVENTION

The present invention provides a grip extender for a handgun. The grip extender provides a relatively continuous surface between the handgun and locked magazine to afford the handgun user with a comfortable grip. In one embodiment, the grip extender has a collar configuration through which fits the magazine to be locked into the handgun. The grip extender fits around the magazine such that when the magazine is locked into the handgun the grip provides a smooth and comfortable fit between the magazine and the handgun butt. The grip extender of the invention can be adapted to fit a variety of handgun models.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

In one aspect, the present invention provides a grip extender for a handgun. The grip extender can be placed over a magazine to be inserted into the handgun and then positioned by locking the magazine in place. The grip extender has a collar configuration, the collar having an aperture sufficient for receiving the handgun's magazine, an upper surface contoured for being received by the handgun's butt lower surface, and a lower surface contoured for receiving the magazine's base. The grip extender of the present invention substantially fills the void about a magazine defined by a magazine fully inserted into a handgun butt. Because the extender can reversibly receive a magazine, magazines can be readily exchanged with a particular extender/handgun combination.

Figure 1:
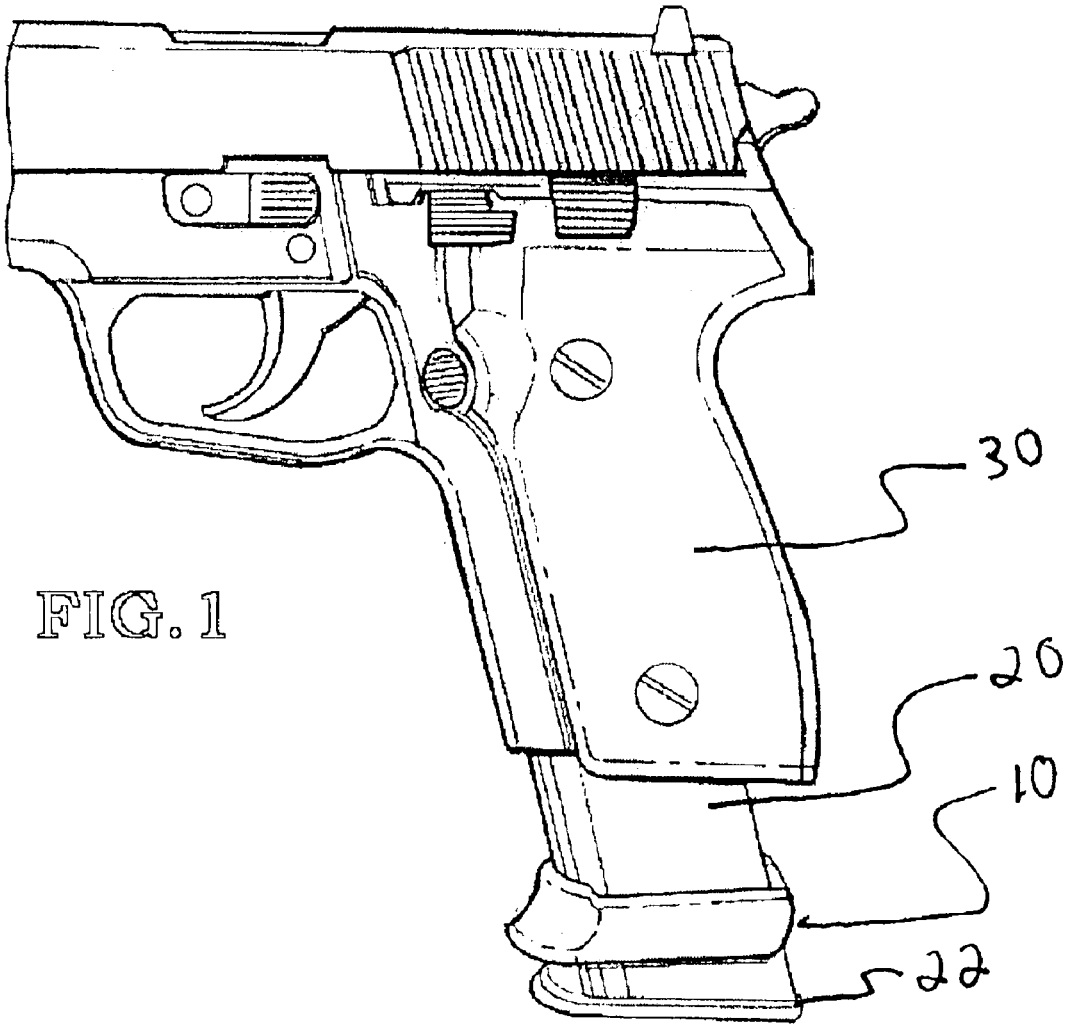
FIG. 1 is a semi-exploded side elevation view of an assembly including a handgun, a magazine, and a representative grip extender of the present invention.
Figure 2:
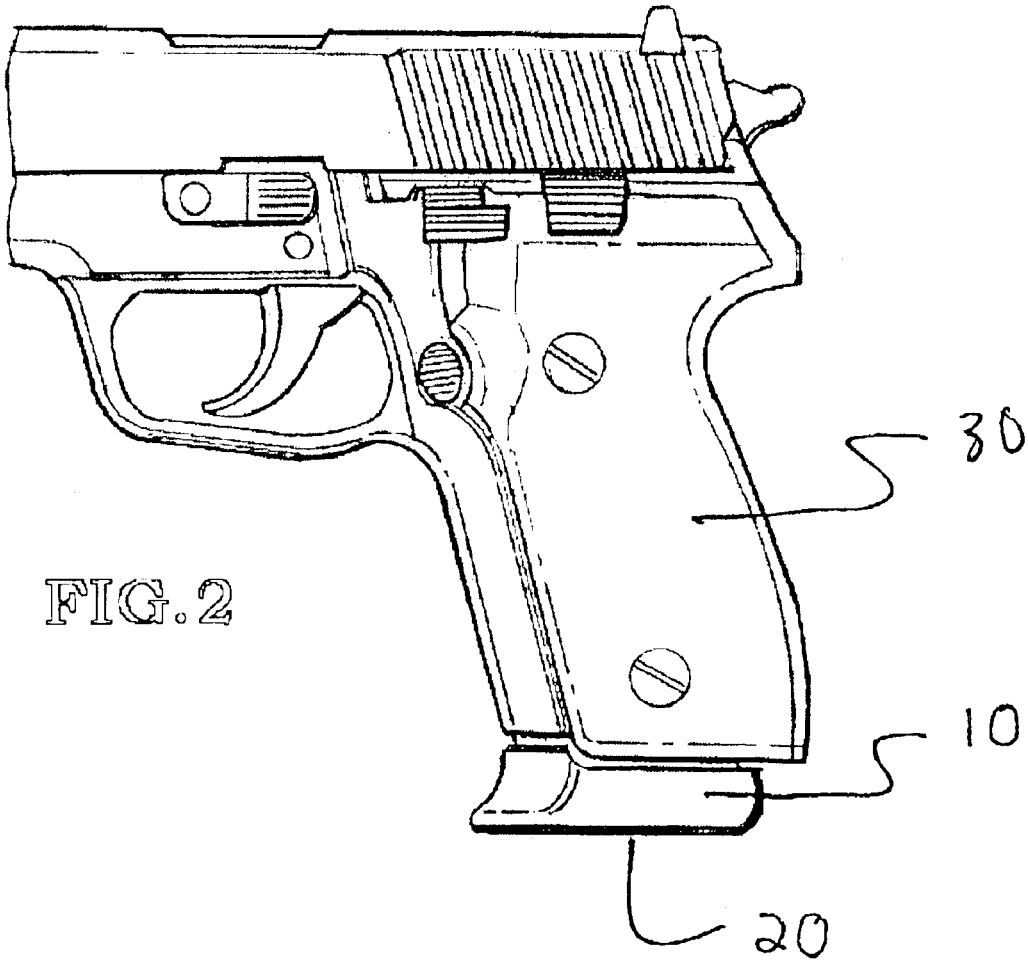
FIG. 2 is a side elevation view of the assembly shown in FIG. 1 with the magazine in the locked position.
Figure 9:
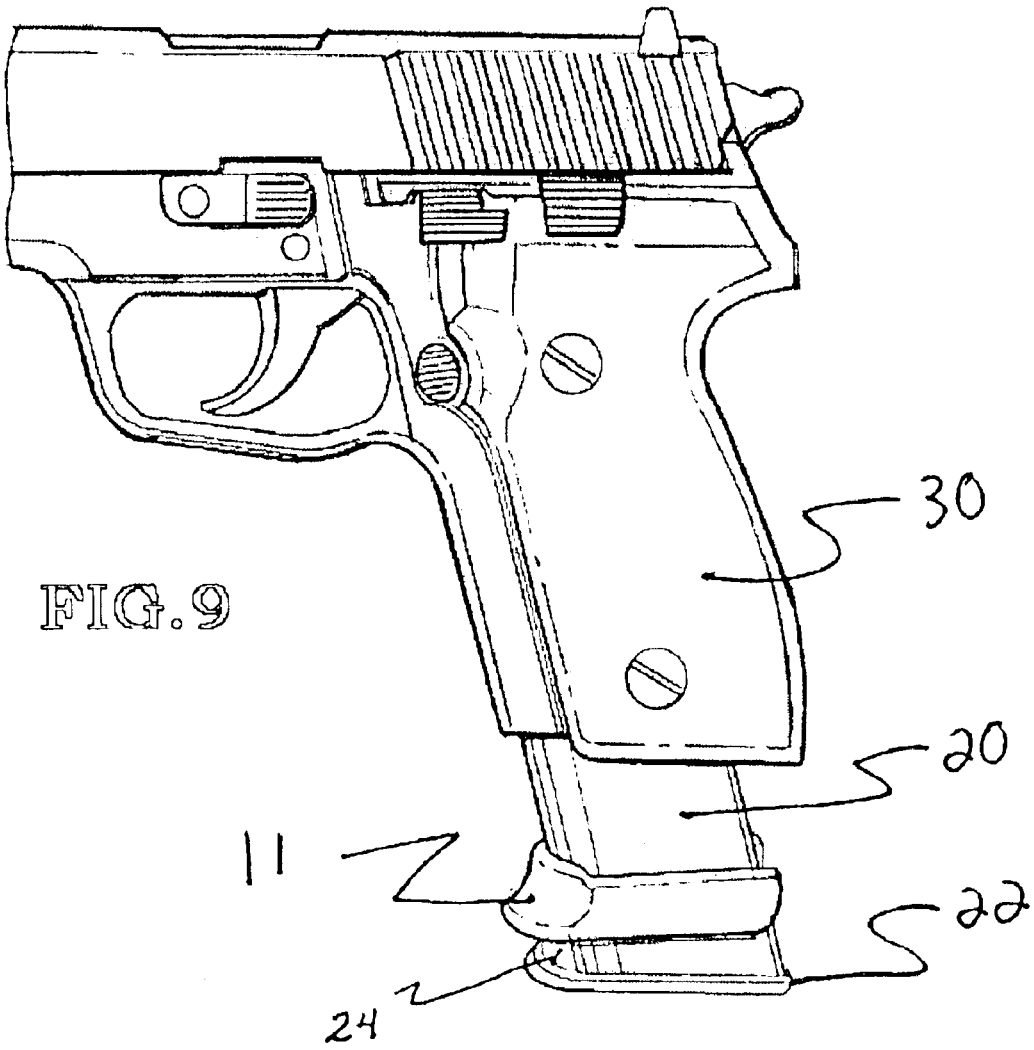
FIG. 9 is a semi-exploded side elevation view of an assembly including a handgun, a magazine, and a representative grip extender of the present invention.

Referring to FIGS. 1, 2, and 9, representative grip extender 10 is adapted to receive and fit about magazine 20 insertable into handgun 30. FIGS. 1 and 9 illustrate the handgun, magazine, and grip extender assembly. FIG. 2 illustrates the handgun, magazine, and grip extender assembly of FIG. 1 with the magazine in the locked position.

Figure 3:
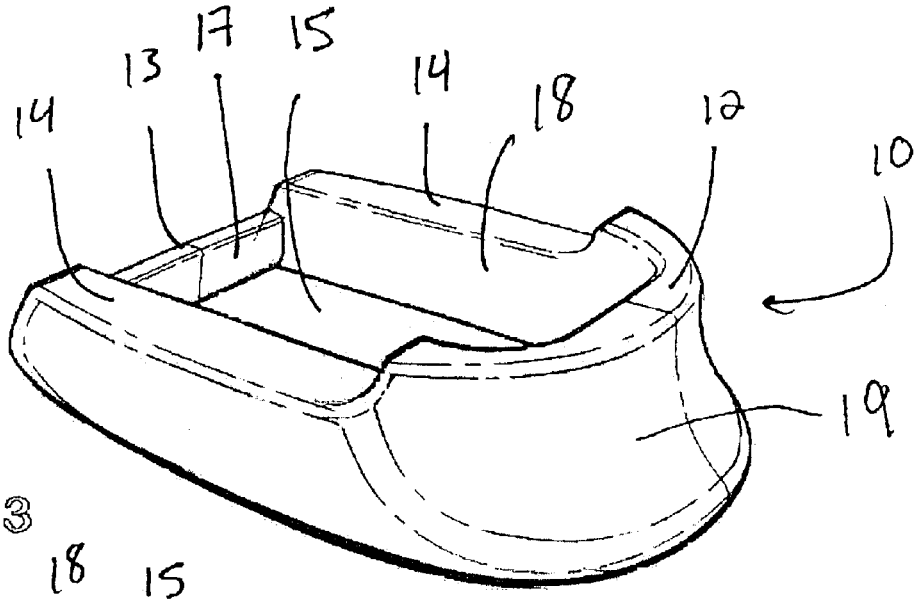
FIG. 3 is an isometric view of a representative grip extender formed in accordance with the present invention.
Figure 4:
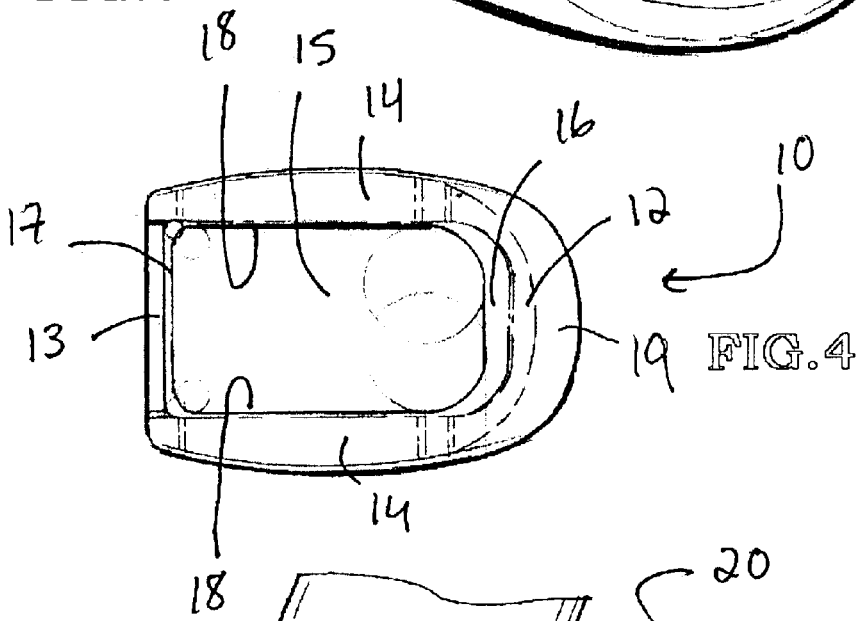
FIG. 4 is a top plan view of a representative grip extender formed in accordance with the present invention.
Figure 5:
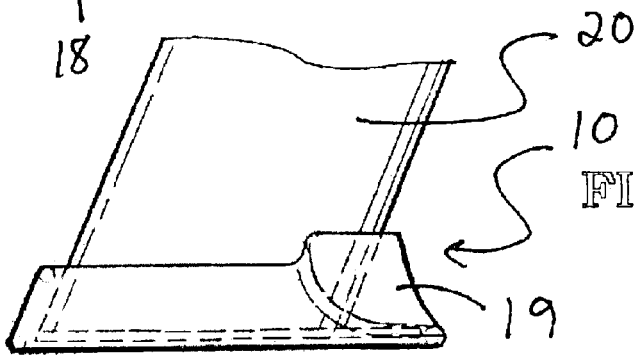
FIG. 5 is a side elevation view of a representative grip extender formed in accordance with the present invention.

A representative embodiment of the grip extender of the invention is illustrated in FIGS. 3–5. In this embodiment the grip extender has a closed-collar configuration. Referring to FIGS. 3 and 4, representative grip extender 10 having a closed-collar shaped body includes an upper surface that is contoured such that the extender is receivable by a handgun butt. Representative extender 10 upper surface includes forward upper surface 12, rearward upper surface 13, and lateral upper surfaces 14. The grip extender's upper surface (e.g., surfaces 12–14) is contoured such that, when in operating position, the extender fits the handgun's butt lower facing surface. By varying the extender's upper surface contour, the extender can be adapted to fit any one of a variety of different model handguns. The grip extender's lower surface is generally smooth and rests against the magazine base (identified as reference numeral 22 in FIG. 1) when the extender is in operating position. As with the extender's upper surface, the lower surface can have a variety of contours such that it is adapted to receive the selected magazine base.

Referring to FIGS. 3 and 4, representative grip extender 10 includes aperture 15 for receiving the handgun's magazine. Aperture 15 is defined by forward interior surface 16, rearward interior surface 17, and lateral interior surfaces 18. Aperture 15 has a size and shape sufficient to receive the magazine and to retain the grip extender at the magazine's base. By varying the extender's aperture, the extender can be adapted to fit any one of a variety of different model magazines.

Referring to FIGS. 3–5, representative grip extender 10 includes forward facing surface 19 contoured to provide a natural finger groove such that, when the grip extender is in its operational position, the extender affords a comfortable grip for the handgun user. The contour can be readily seen in FIGS. 1–9.

As illustrated in FIGS. 1–9, the grip extender of the invention can have a height and thickness sufficient to fill the gap defined by a magazine fully inserted into a handgun butt. As used herein, the term "height" refers to the dimension generally from the magazine base toward the handgun handle (i.e., from the extender's lower surface to t its upper surface). The grip extender can have a variety of thicknesses. As used herein, the term "thickness" refers to the dimension generally from the magazine outward to the handgun outer surface (i.e., from the extender's interior surface to its outer surface). In one embodiment, the extender has a thickness sufficient to provide a substantially continuous surface from the handgun butt to the magazine base.

Figure 6:
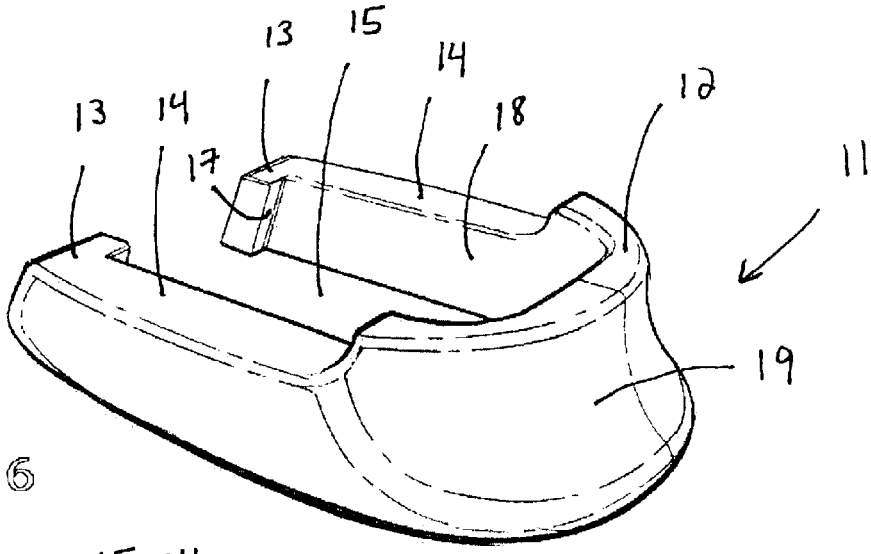
FIG. 6 is an isometric view of a representative grip extender formed in accordance with the present invention.
Figure 7:
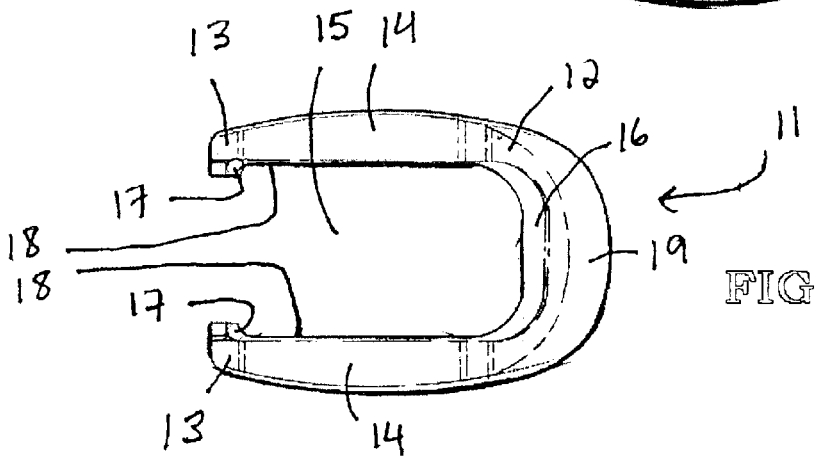
FIG. 7 is a top plan view of a representative grip extender formed in accordance with the present invention.
Figure 8:
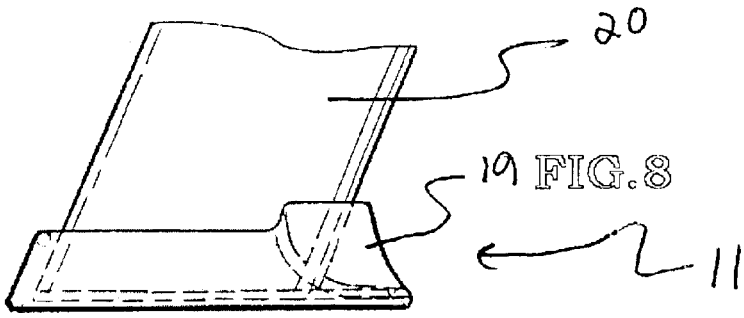
FIG. 8 is a side elevation view of a representative grip extender formed in accordance with the present invention.

Another representative embodiment of the grip extender of the invention is illustrated in FIGS. 6–8. In this embodiment the grip extender has a substantially U-shaped configuration. Referring to FIGS. 6 and 7, representative grip extender 11 having a substantially U-shaped body includes an upper surface that is contoured such that the extender is receivable by a handgun butt. Representative extender 11 upper surface includes forward upper surface 12, rearward upper surface 13, and lateral upper surfaces 14. The grip extender's upper surface (e.g., surfaces 12–14) is contoured such that, when in operating position, the extender fits the handgun's butt lower facing surface. The extender can be adapted to fit any one of a variety of different model handguns. The grip extender's lower surface is generally smooth and rests against the magazine base (identified as reference numeral 22 in FIG. 1) when the extender is in operating position. As with the extender's upper surface, the lower surface can have a variety of contours such that it is adapted to receive the selected magazine base.

Referring to FIGS. 6 and 7, representative grip extender 11 includes aperture 15 for receiving the handgun's magazine. Aperture 15 is defined by forward interior surface 16, rearward interior surfaces 17, and lateral interior surfaces 18. Aperture 15 has a size and shape sufficient to receive the magazine and to retain the grip extender at the magazine's base. By varying the extender's aperture, the extender can be adapted to fit any one of a variety of different model magazines.

Referring to FIGS. 6–8, representative grip extender 11 includes forward facing surface 19 contoured to provide a natural finger groove such that, when the grip extender is in its operational position, the extender affords a comfortable grip for the handgun user. The contour can be readily seen in FIGS. 1–9.

As noted above, the grip extender of the present invention can be formed to suit any one of a variety of handgun and magazine models. The grip extender's collar configuration can be varied such that a particular magazine can fit through and retain the extender. The grip extender's upper surface can also be varied to receive a particular handgun butt. Likewise, the grip extender's lower surface can be varied to receive a particular magazine. The representative grip extenders illustrated in FIGS. 1–9 are formed to receive a Sig Sauer Model 228 utilizing a full size magazine from Sig Sauer Model 226. It will be appreciated that the grip extender of the invention can be formed to be adapted to a variety of handguns and magazines.

Figure 10:
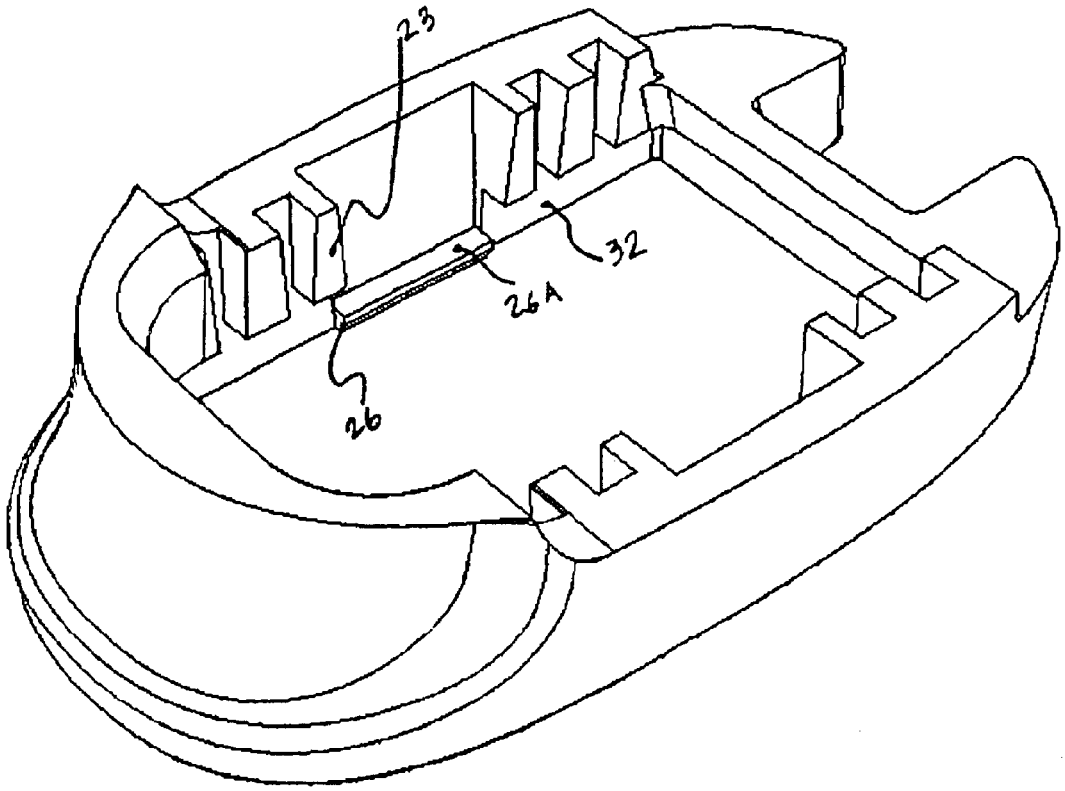
FIG. 10 is an isometric view of the preferred embodiment incorporating features that captures those types of magazines with larger periphery floor plates.

To fit a handgun with the grip extender of the present invention, the handgun's magazine is inserted through the grip extender with the extender's upper surface facing toward the top of the magazine and then slide down the magazine until seated at the bottom of the magazine; the magazine with surrounding grip extender is then inserted into the handgun butt (see FIGS. 1 and 9); and the magazine locked into position (see FIG. 2). FIG. 10 shows the preferred embodiment of the invention using the Sig Sauer Model 226 magazine. The Sig Sauer Model 226 magazine, and many other magazines for a variety of handguns, has a floor plate 24 (FIG. 9) that has a periphery larger than the periphery of the magazine body. The preferred embodiment uses this floor plate periphery to allow the grip extender to capture the magazine securely. FIG. 10 shows a tang 26, with a stepped surface 26A parallel to the floor plate of the magazine. This tang is slightly deformed away from the magazine as the grip extender is slid down the length of the magazine. As the tang travels past the floor plate it elastically returns to its original conformation thereby placing the step of the tang 26A under the bottom of the floor plate, with the bottom shoulder of the ribs 23 supporting the top of the floor plate, securing the grip extender to the magazine. The ribbing of these supports allows them to slightly deform as the grip extender is mounted onto the magazine, again helping to secure the fit.

It will be appreciated that this design can include the grip extender having material 32 that extends below the lower surface of floor plate thereby protecting the extended handgun magazine by absorbing shocks that may occur by releasing the magazine from the pistol and letting the magazine drop onto a hard surface.

Ammunition cartridges used in handguns come in a variety of gunpowder loads usually measured in grains of powder and slug types and slug coatings such as hollow points, full metal jackets, and Teflon coatings, among others. Being able to differentiate which cartridges are loaded in which magazines would make it easier to select the correct cartridge for a particular circumstance. It is another object of the present invention to use the grip extender shape or color to allow that distinguishing to occur. The grip extender may have embossed or debossed features such as bumps or dots to allow tactile differentiation. Colors, either molded in or added later to the grip extender, may be used to visually select the magazine with the appropriate cartridge for the situation. Or a combination of colors and physical features may be used.

The grip extender of the present invention can be formed as a molded plastic piece from a variety of materials. Suitable materials include elastomeric materials, such as plastics, for example, nylon, glass filled nylon and ABS, among others. For use in extremely cold climates a high impact glass filled nylon may be selected.

While the preferred embodiment of the invention has been illustrated and described, it will be appreciated that various changes can be made therein without departing from the spirit and scope of the invention.

I claim:

1. A grip extender in combination with a handgun comprising: a handgun using a variety of different model magazines, a grip extender with symmetrical interior side walls, an exterior front wall configured to a user's grip, and a rear wall, for use with the handgun magazine to fill a gap between the magazine and the handgun, with said magazine having an open top for loading ammunition cartridges and a closed bottom for containing said ammunition cartridges, said closed bottom ending in a floor plate, of determinable thickness, with a lower surface and an upper surface, with said floor plate also having a peripheral surface larger than a peripheral surface of a corresponding body of the magazine, said grip extender further comprising:

a) a one-piece collar slideably mounted from the open top of said magazine and subsequently seated at the closed bottom of said magazine thereby substantially filling any gap resulting from a length of the magazine protruding from a handgun when said magazine is engaged into said handgun, said collar having a size and shape sufficient to elastically receive and grip the magazine and magazine floor plate thereby securely retaining the collar and having at least one pair of opposed tangs oriented inward from the interior side walls of the collar; and b) further comprising at least one pair of opposed ribs, said ribs oriented inward from the interior side walls of the collar, with a bottom shoulder of said ribs distanced above the tangs, said distance approximately equal the determinable thickness of the magazine floor plate; and c) when sliding the grip extender into its final position on the magazine, a step of the said tangs engages the lower surface of the floor plate and captures the corresponding upper surface of floor plate against said the bottom shoulders of the opposed ribs.

2. The grip extender of claim 1 wherein said grip extender is further comprised of a color, said color corresponding to a type of ammunition cartridge to be carried by said magazine.

3. The grip extender of claim 1 wherein said grip extender further incorporates an embossed or debossed feature, said feature corresponding to a type of ammunition cartridge to be carried by said magazine.

4. The grip extender claim 1 further comprising a lower surface depending below the magazine floor plate thereby protecting said magazine from impacts with surfaces when the magazine is released from a handgun during reloading.

* * * * *